US006484362B1

(12) United States Patent
Kuo

(10) Patent No.: US 6,484,362 B1
(45) Date of Patent: Nov. 26, 2002

(54) RETRACTABLE HANDLE ASSEMBLY WITH MULTIPLE ENGAGING POSITION FOR WHEELED LUGGAGE

(75) Inventor: Chung Hsien Kuo, Pan-Chiao (TW)

(73) Assignee: Chaw Khong Technology Co. Ltd., Taipei (TW)

( * ) Notice: Subject to any disclaimer, the term of this patent is extended or adjusted under 35 U.S.C. 154(b) by 0 days.

(21) Appl. No.: 09/504,210

(22) Filed: Feb. 15, 2000

Related U.S. Application Data

(60) Provisional application No. 60/120,332, filed on Feb. 17, 1999.

(51) Int. Cl.[7] ..... A45C 13/26
(52) U.S. Cl. ..... 16/113.1; 190/115; 280/47.371
(58) Field of Search ..... 16/113.1, 405, 16/429; 190/39, 115; 280/47.135, 47.371, 655, 655.1

(56) References Cited

U.S. PATENT DOCUMENTS 5,488,756 A * 2/1996 Hsieh ..... 16/113.1
5,692,266 A * 12/1997 Tsai ..... 16/113.1
5,803,214 A * 9/1998 Wang ..... 16/405
5,806,143 A * 9/1998 Tsai ..... 16/405
5,836,052 A * 11/1998 Chou ..... 16/405
5,875,520 A * 3/1999 Chang ..... 16/405
5,941,936 A * 8/1999 Deliman et al. ..... 190/39
5,956,807 A * 9/1999 Kuo ..... 16/405
6,079,527 A * 6/2000 Kuo ..... 190/115
6,128,806 A * 10/2000 Shou-Mao ..... 16/113.1
6,170,122 B1 * 1/2001 Kuo ..... 16/405

* cited by examiner

*Primary Examiner*—Anthony Knight
*Assistant Examiner*—Doug Hutton
(74) *Attorney, Agent, or Firm*—Troxell Law Office PLLC

(57) ABSTRACT

A handle assembly for wheeled luggage comprises a handle grip with a push button, a pair of identical outer tubes, a pair of identical inner tubes slidingly engaged with the outer tubes, and a pair of locking mechanisms each having a locking pin connected to an end of an inner tube wherein the disengagement of locking pins from the corresponding slots in a stowed-away position, partially extended position, or fully extended position is carried out by pressing the push button to cause a flexible steel cable in either inner tube connected between the locking pin and the push button to move the locking pin completely within the corresponding slot.

6 Claims, 15 Drawing Sheets

RETRACTABLE HANDLE ASSEMBLY WITH MULTIPLE ENGAGING POSITION FOR WHEELED LUGGAGE

RELATED APPLICATIONS

This application claims the benefit of provisional application No. 60/120,332 filed on Feb. 17, 1999 entitled "Off-Centered Dual-Purpose Handle Assembly for Wheeled Luggage", which application is now abandoned.

FIELD OF THE INVENTION

The present invention relates to a handle assembly for wheeled luggage and more particularly to a retractable handle assembly with multiple engaging positions for wheeled luggage.

BACKGROUND OF THE INVENTION

Wheeled luggage has been widely used in recent years by travelers in various forms of transportation. A typical design is to mount a retractable handle assembly to a side of luggage being fastened to frame of luggage by an attachment means. This design is convenient for user to access handle such as that described in U.S. Pat. No. 5,624,012. But such designs are unsatisfactory because the center of gravity of luggage may tilt which in turn causes the lower portion including wheels to interfere with user's body when luggage is carried. Further, in order to carry or lift the luggage, a separate handle assembly is provided on luggage case in addition to the pull-handle system as described in the above patent. But this design is disadvantageous because it protrudes from the surface of luggage case permanently and cannot be retracted into a recess. Additionally, it is neither aesthetic nor cost effective.

More recently, the airline industry has strictly enforced the restriction on the dimensions of carry-on luggage that may be brought onboard of an airplane. A protruded carry handle used on a wheeled luggage for carrying purpose further adds to the dimensions and may disqualify a luggage to be carried onboard an airplane.

The need for a handle system that can be completely stowed away in a recess built into the luggage case, can be used to both pull luggage on wheels or to carry luggage when needed has been long existing but unfulfilled.

SUMMARY OF THE INVENTION

It is therefore an object of the present invention to provide a retractable handle assembly with multiple engaging positions for wheeled luggage that does not have the drawbacks of conventional retractable handle assembly.

It is another object of the present invention to provide a retractable handle assembly with multiple engaging positions for wheeled luggage that can be used for both pulling luggage on wheels or carrying wheel without interfering when needed.

It is another object of the present invention to provide a retractable handle assembly with multiple engaging positions for wheeled luggage wherein the center line of handle assembly about coincides with the center of gravity of luggage for facilitating user to carry luggage.

It is a further object of the present invention to provide a retractable handle assembly with multiple engaging positions for wheeled luggage that can be locked in two operating positions for pulling and carrying luggage.

It is still further object of the present invention to provide a retractable handle assembly with multiple engaging positions for wheeled luggage having the advantages of simple structure, easy assembly, and lower manufacturing cost.

It is still further object of the present invention to provide a handle assembly comprising a handle grip with a push button, a pair of identical outer tubes, a pair of identical inner tubes slidingly engaged, with the outer tubes, and a pair of locking mechanisms each having a locking pin connected to an end of an inner tube wherein the disengagement of locking pins from the corresponding slots in a stowed-away position, partially extended position, or fully extended position is carried out by pressing the push button to cause a flexible steel cable in either inner tube connected between the locking pin and the push button to move the locking pin completely within the corresponding slot.

The above and other objects, features and advantages of the present invention will become apparent from the following detailed description taken with the accompanying drawings.

DETAILED DESCRIPTION OF PREFERRED EMBODIMENTS

Figure 1:
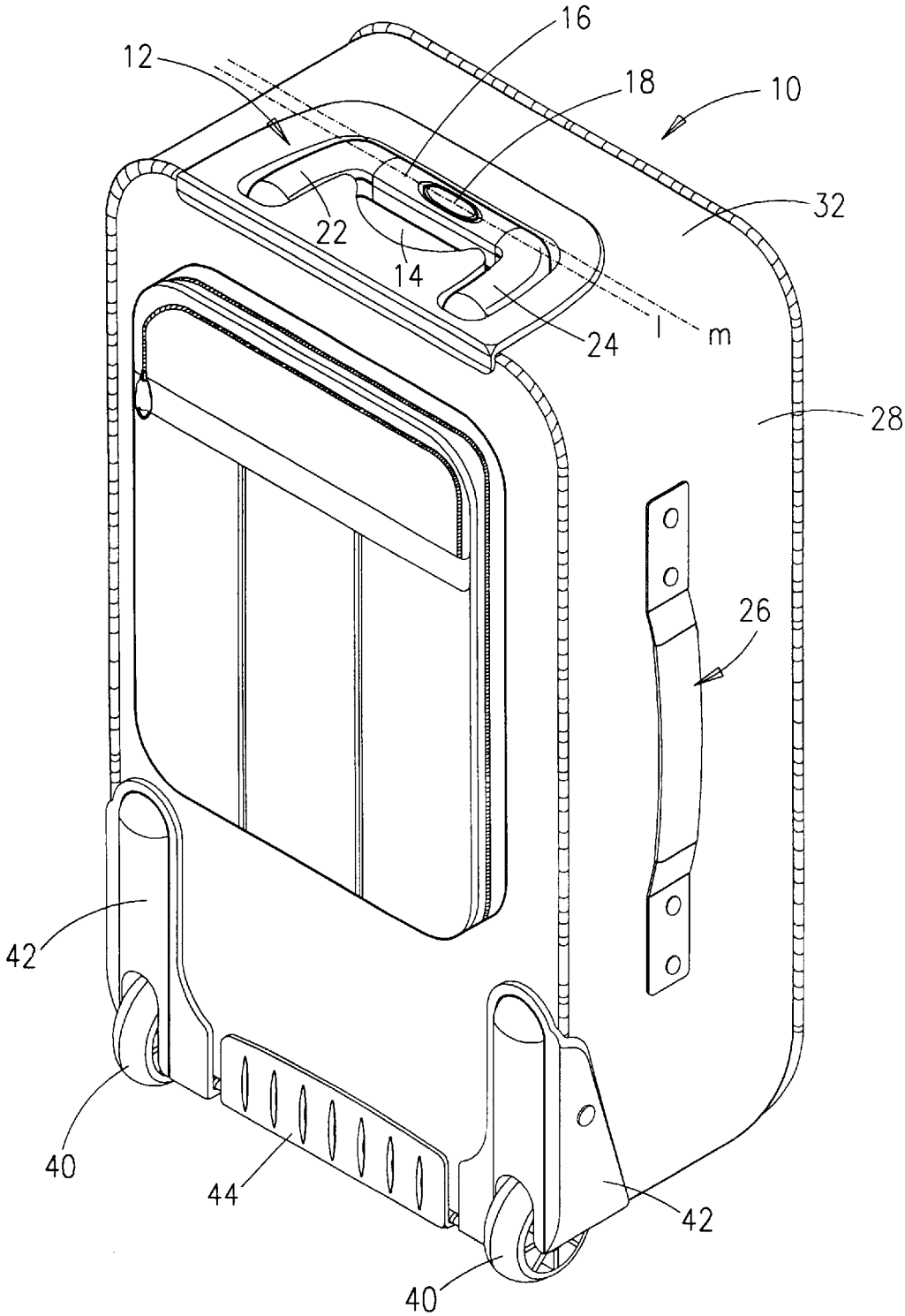
FIG. 1 is a perspective view of the present invention wheeled luggage illustrating the handle grip being mounted to the luggage in a stowed-away position.

Referring to FIG. 1, there is shown a retractable handle assembly 12 with multiple engaging positions for a wheeled luggage 10 constructed in accordance with the present invention wherein handle assembly 12 is in a stowed-away position and stored in bezel 14.

The U-shaped handle assembly 12 is constructed by a handle grip 16 which houses a recessed push button 18 at a center location connected by two side pieces 22, 24 to the inner tubes (not shown). The wheeled luggage 10 is further equipped with a carrying handle 26 mounted on the side 28 of luggage for carrying the luggage sideways. However, it should be noted that there is no carrying handle provided on the top 32 of luggage 10. The novel handle assembly 12 of the present invention serves both as a pull handle and as a carrying handle. Note that center line "I" for the handle grip 16 is designed such that it is positioned away from the center line "m" for the top 32 of luggage 10. It should be further noted that the center line "I" for handle grip 16 can be positioned on either side of the center line "m" for the luggage such that the luggage can be carried with either the wheels; perpendicular to ground surface or away from the user. This is further shown in detail in FIGS. 13A–13C.

Figure 2:
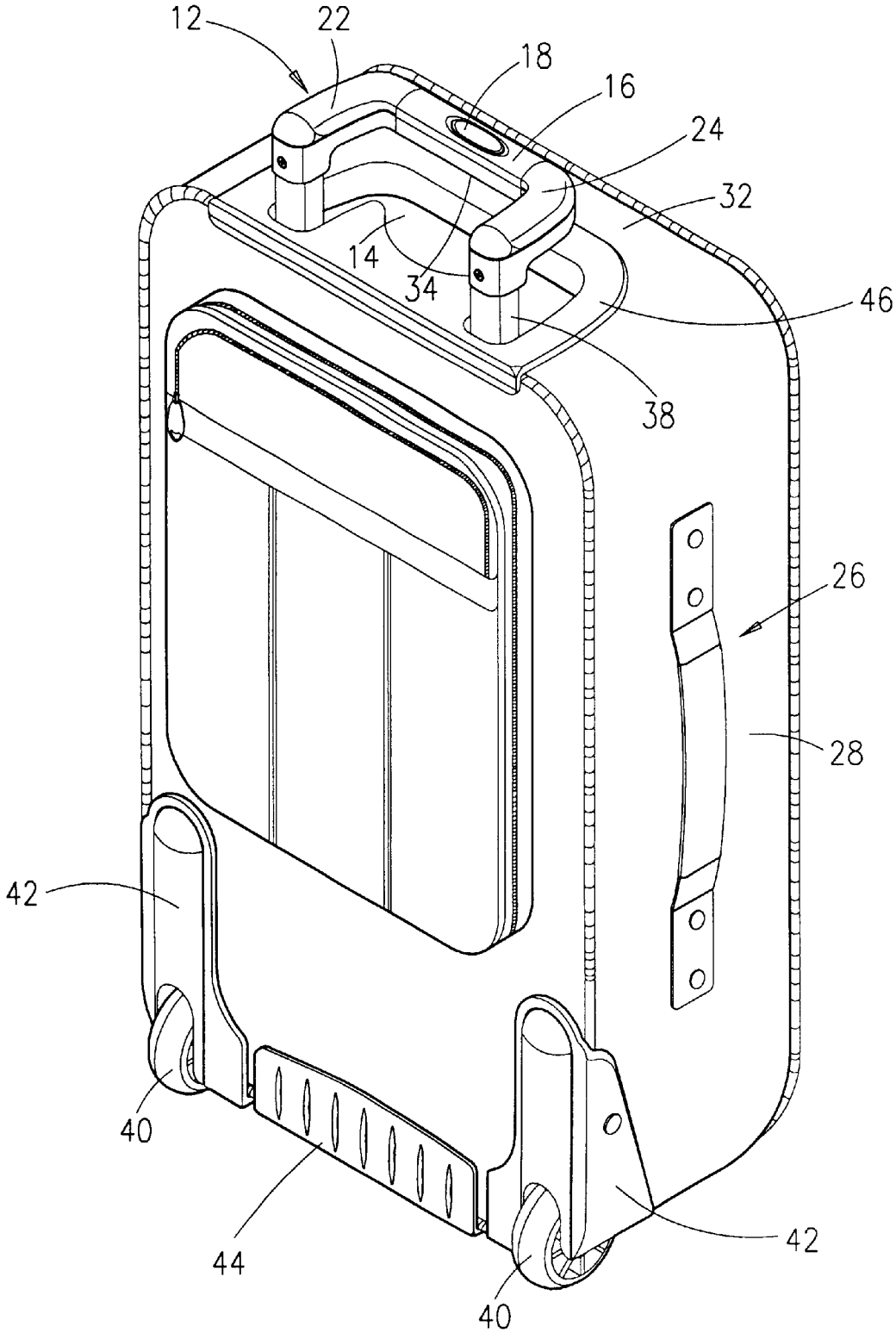
FIG. 2 is a perspective view of the present invention wheeled luggage of FIG. 1 with handle grip partially extended and locked in a carrying position.

FIG. 2 is a perspective view of the present invention wheel 10 with handle assembly 12 in a partially extended position for carrying of the luggage. The partially extended handle system 12 may be suitably locked by a locking mechanism (not shown) connected to the inner tubes of handle assembly 12 at any suitable positions. At this position the handle grip 16 may allow user to comfortably grip the handle grip 16 with sufficient clearance between the grip 16 and the bezel 14 in the top 32.

Figure 3:
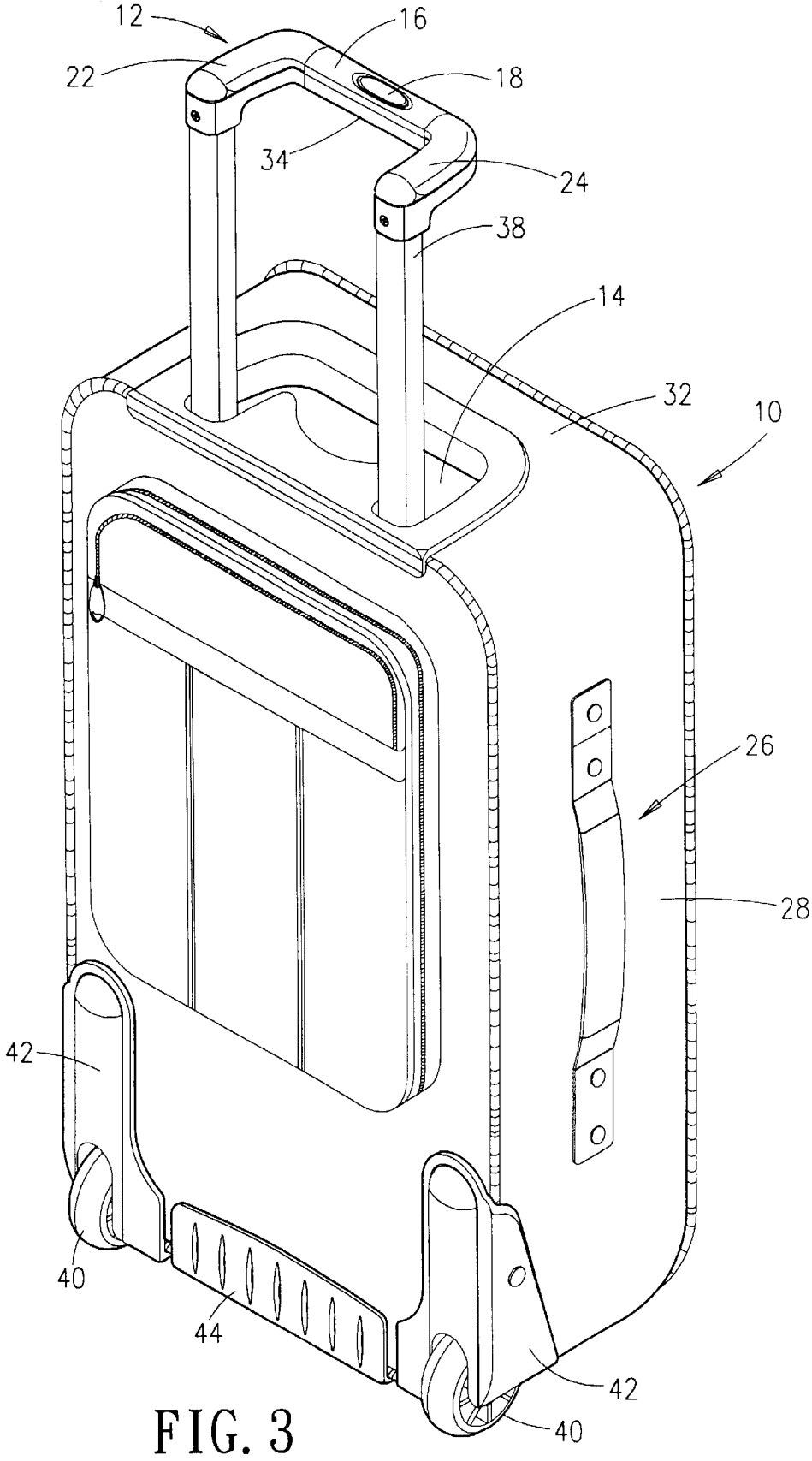
FIG. 3 is a perspective view of the present invention wheeled luggage with handle grip in a fully retracted position for operating the luggage on wheels.

As shown in FIG. 3, when handle assembly 12 is pulled out completely such that it is in a fully extended position as shown in FIG. 3, the handle assembly 12 or handle grip 16 can be used to pull or push the wheeled luggage 10 on its wheels 40. The wheels 40 are mounted in plastic housing 42 with a kick plate 44 mounted therebetween.

Figure 4:
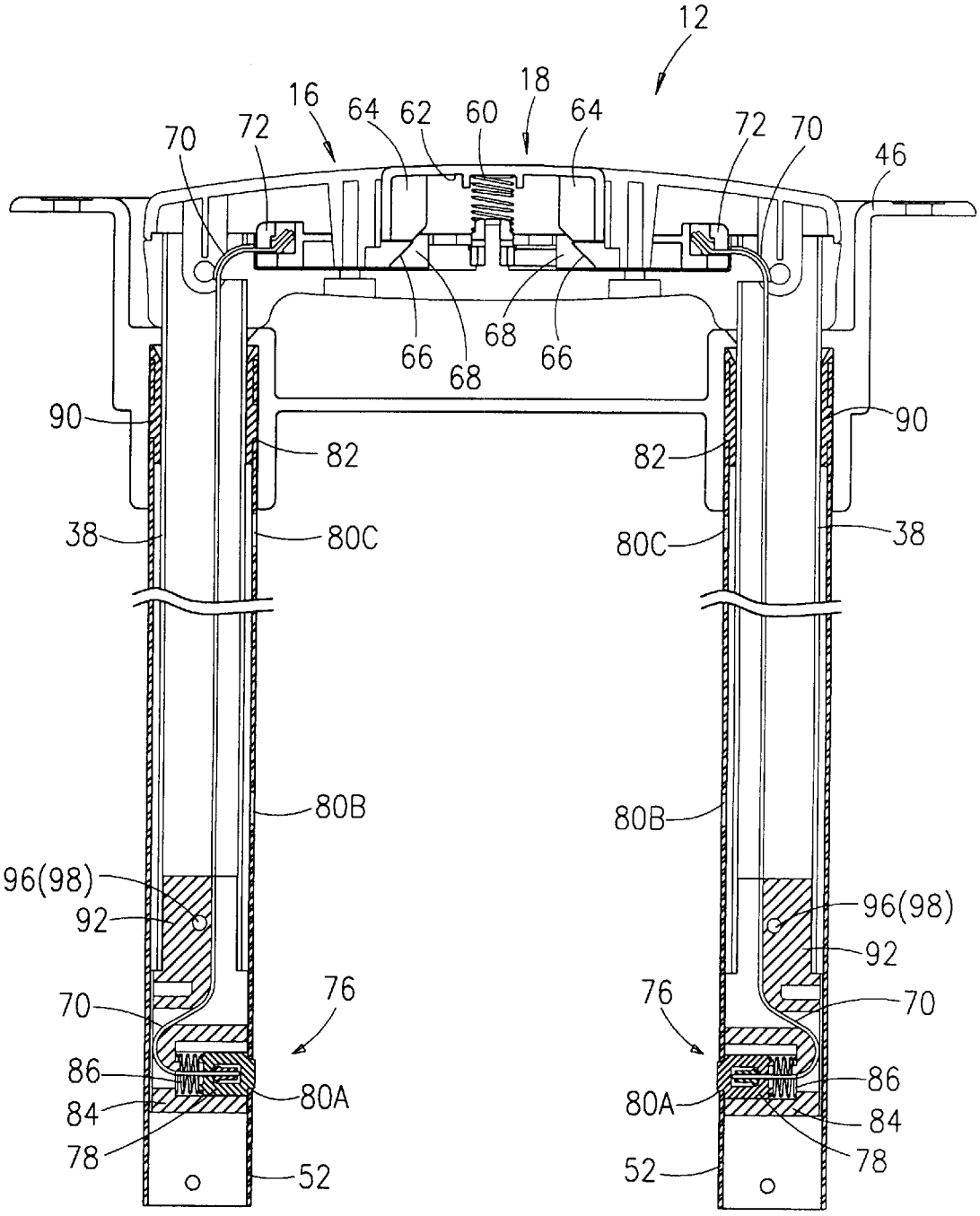
FIG. 4 is a sectional view of the handle assembly of the present invention wheeled luggage.

FIG. 4 is a sectional view of the handle assembly 12 with the push button 18 in a released position. As shown, push button 18 operates by a compressible spring 60 which supports a bottom surface 62 of push button 18. Two wedges 64 projecting downwardly from the bottom of push button 18 and are arranged symmetrically to the center of push button 18. The wedges 64 are equipped with inclined bottom surfaces 66 which engage a pair of sliding blocks 68 such that when push button 18 is pressed downwardly against the spring 60, the inclined surfaces 66 engage sliding blocks 68 and pull them toward the center. Flexible steel cables 70 attached to sliding blocks 68 through cable mounting blocks 72 are thus pulled up. The lower ends of flexible steel cables 70 are operatively attached to the locking mechanisms 76 which will be described in detail later.

Figure 5:
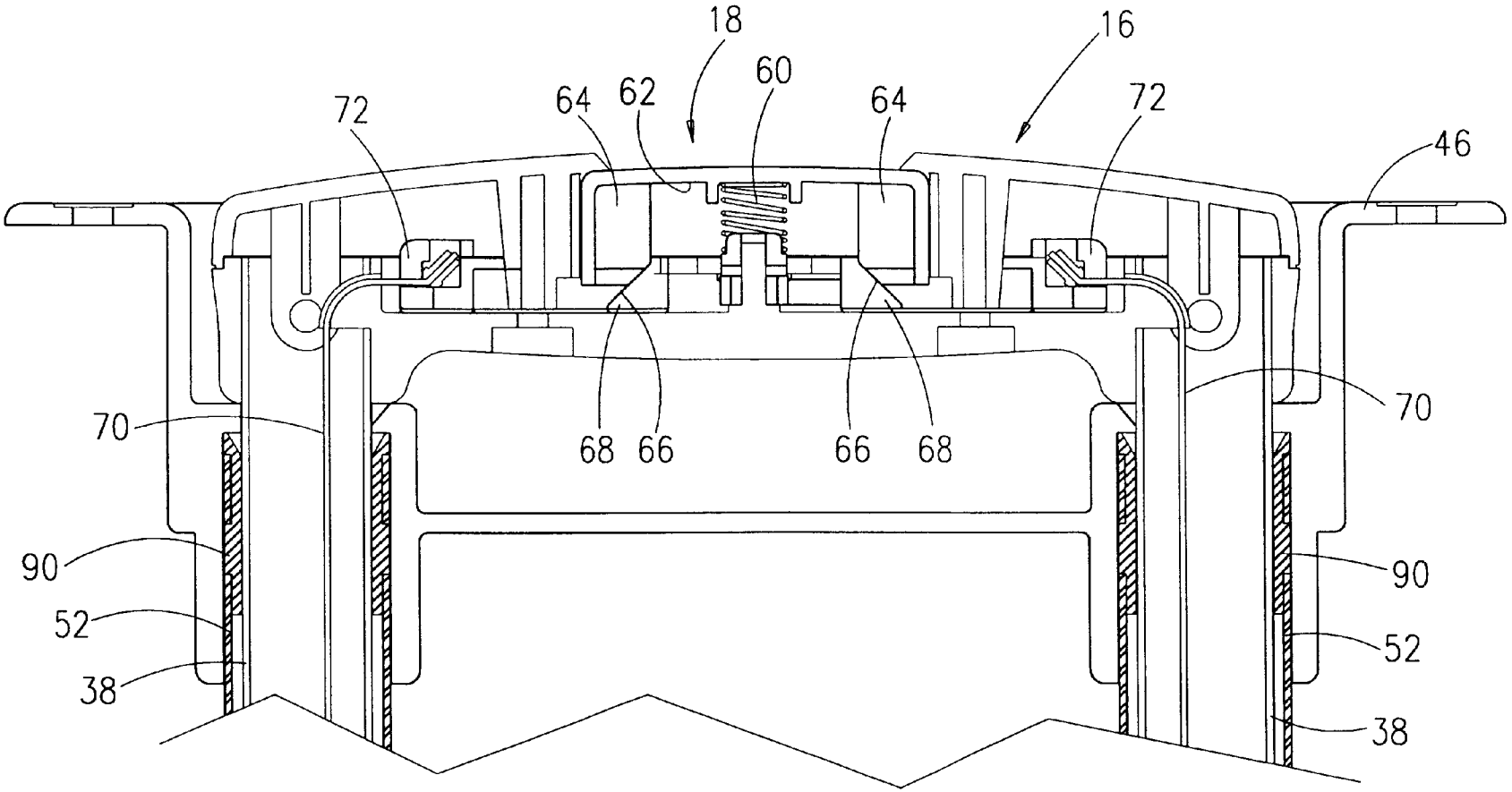
FIG. 5 is a sectional view of the handle assembly with the push button in a pressed-down position.

FIG. 5 is a sectional view of the handle assembly 12 with push button 18 in a pressed-down position wherein sliding blocks 68 are pushed toward the center of push button 18 which in turn causes flexible steel cables 70 to move with respect to cable mounting blocks 72.

Figure 6:
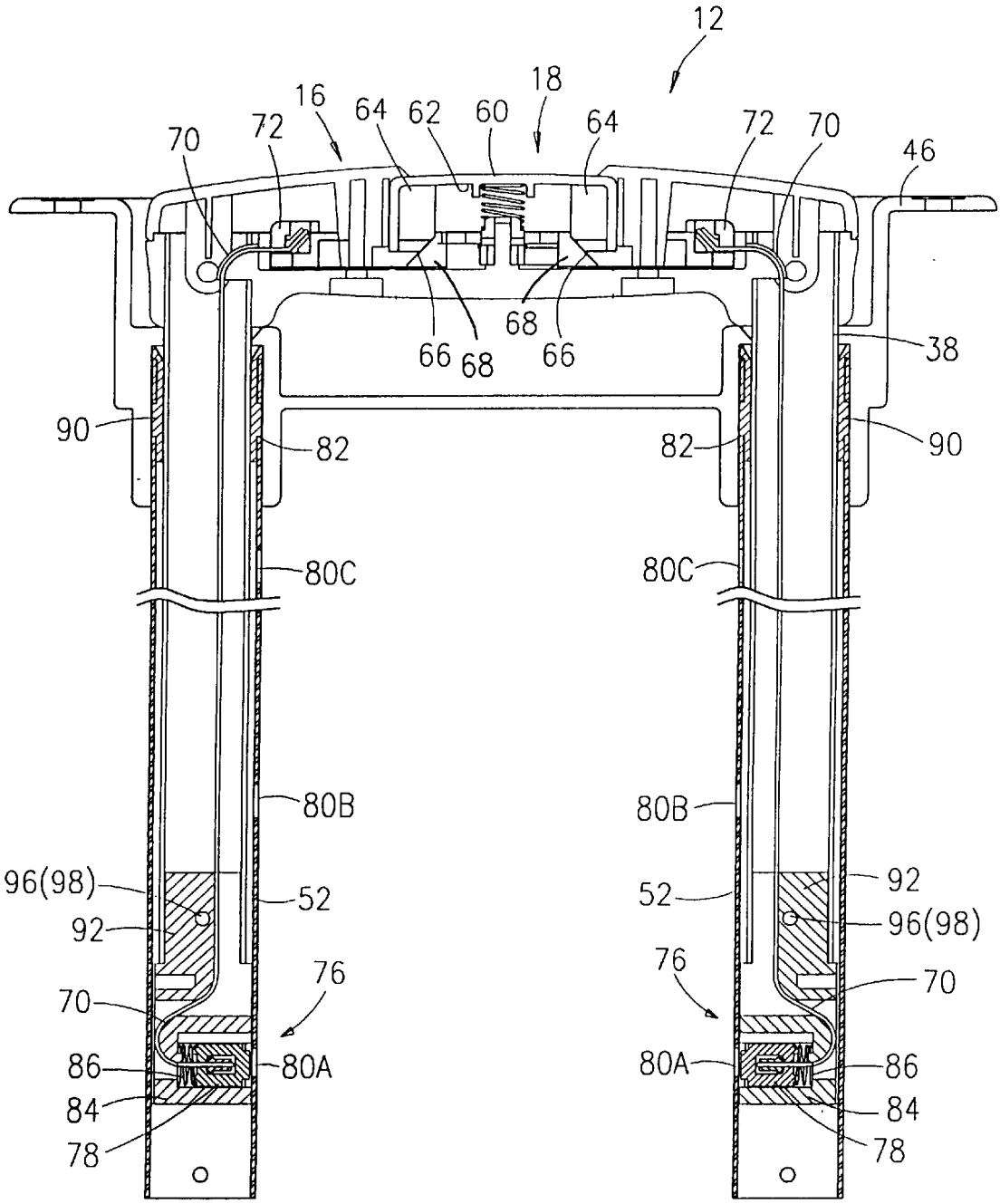
FIG. 6 is sectional view of the handle assembly of the present invention wheeled luggage shown in FIG. 5 with the push button in a pressed-down position and locking pins disengaged from the lower slots in the outer tubes.

FIG. 6 is a sectional view of the handle assembly 12 shown in FIG. 5 with the push button 18 in a pressed-down position wherein locking pins 78 of locking mechanisms 76 disengage from the lower slots 80A in the outer tubes 52 such that inner tubes 38 may slide in outer tubes 52.

Figure 7:
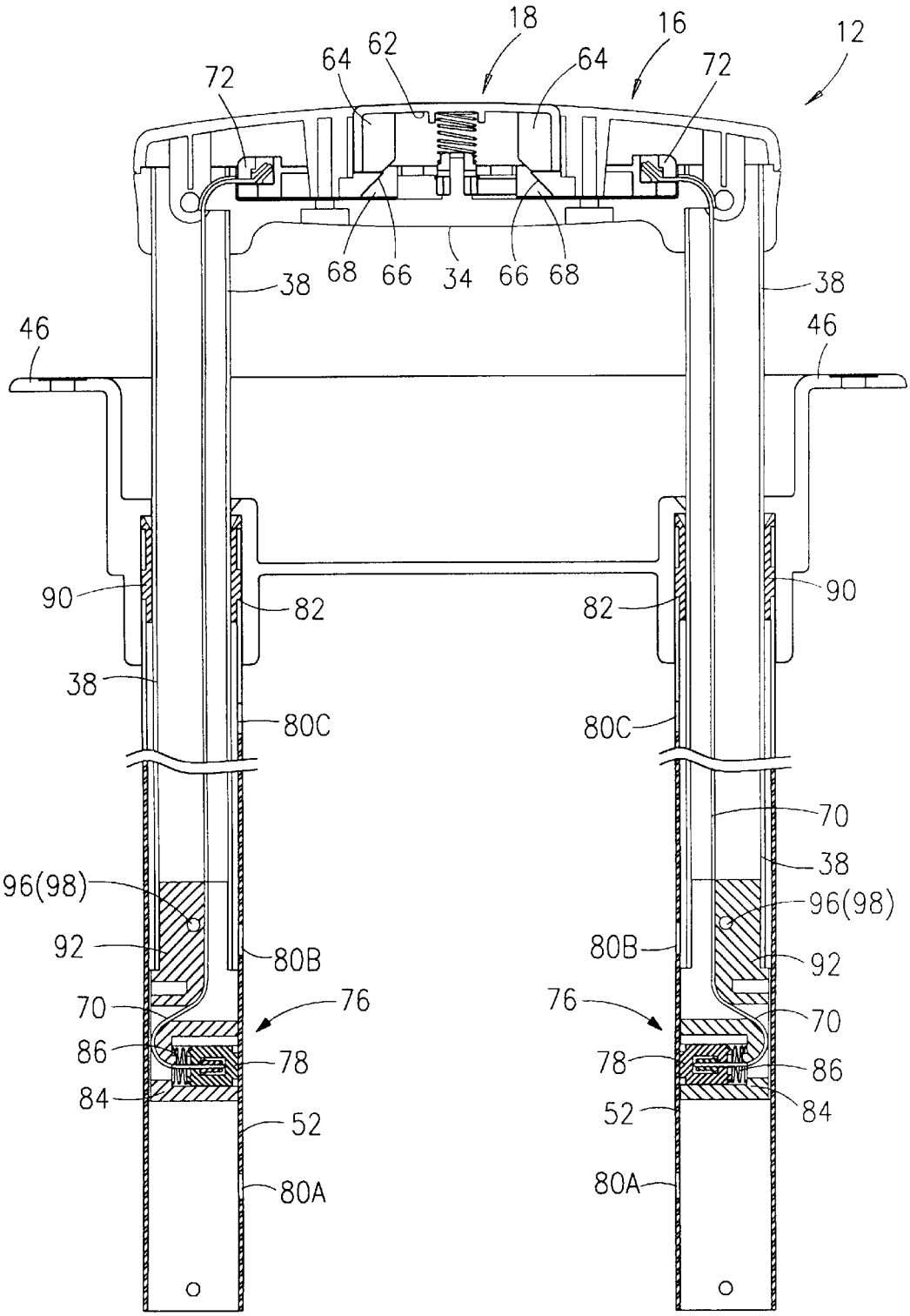
FIG. 7 is sectional view of the handle assembly of the present invention wheeled luggage with push button in a released position and locking pins disengaged from the lower slots.

FIG. 7 is a sectional view of the handle assembly 12 wherein locking pins 78 of locking mechanisms 76 are retracted into outer tubes 52 to be in sliding contact with the inner wall of outer tubes 52.

Figure 8:
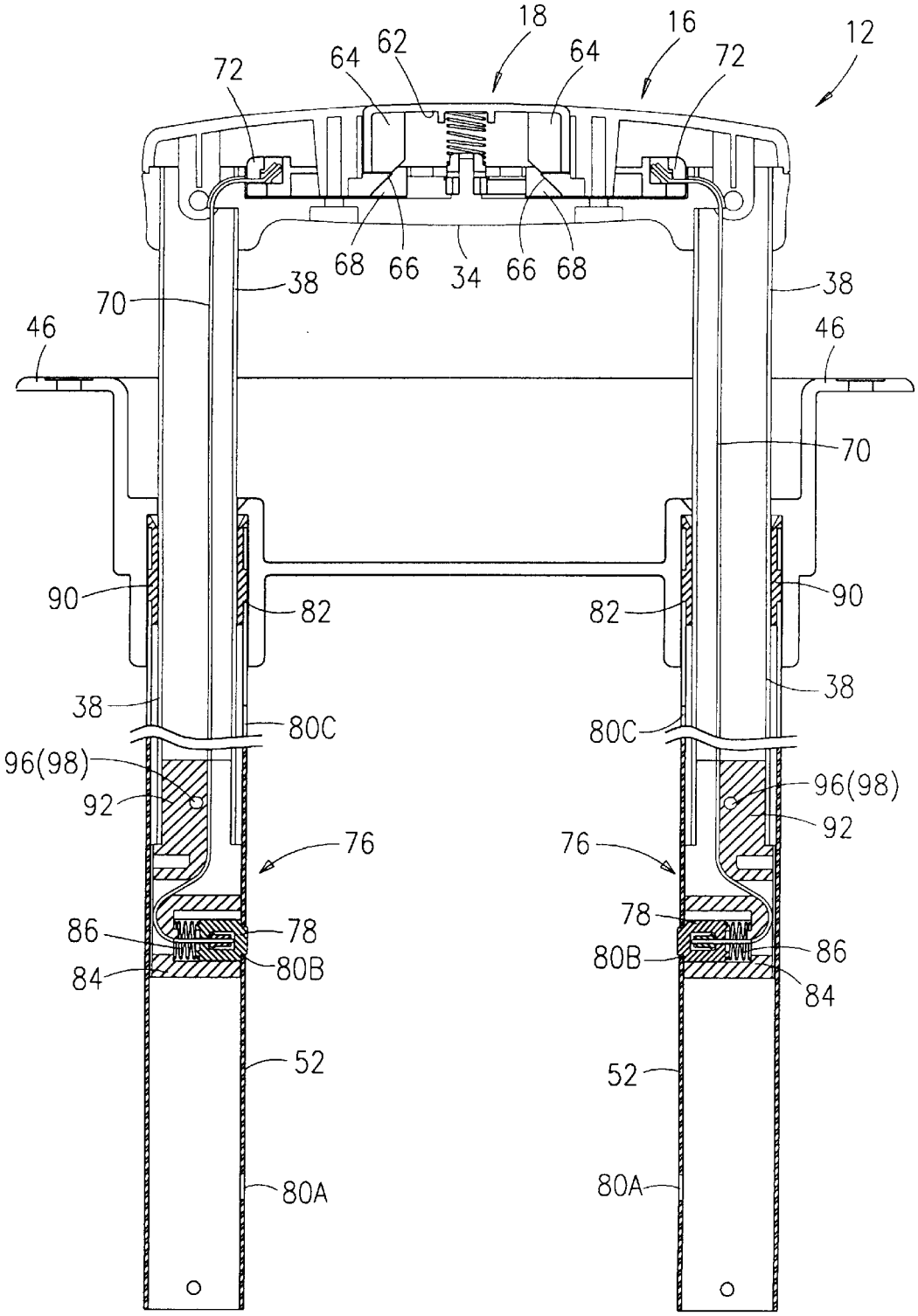
FIG. 8 is sectional view of the handle assembly of the present invention wheeled luggage with push button in. a released position and locking pins engaged with the middle slots in the outer tubes for carrying the luggage.

FIG. 8 is a sectional view of the handle assembly 12 with locking pins 78 engaged with the middle slots 80B in the outer tubes 52. At this position user can carry the luggage 10.

Figure 9:
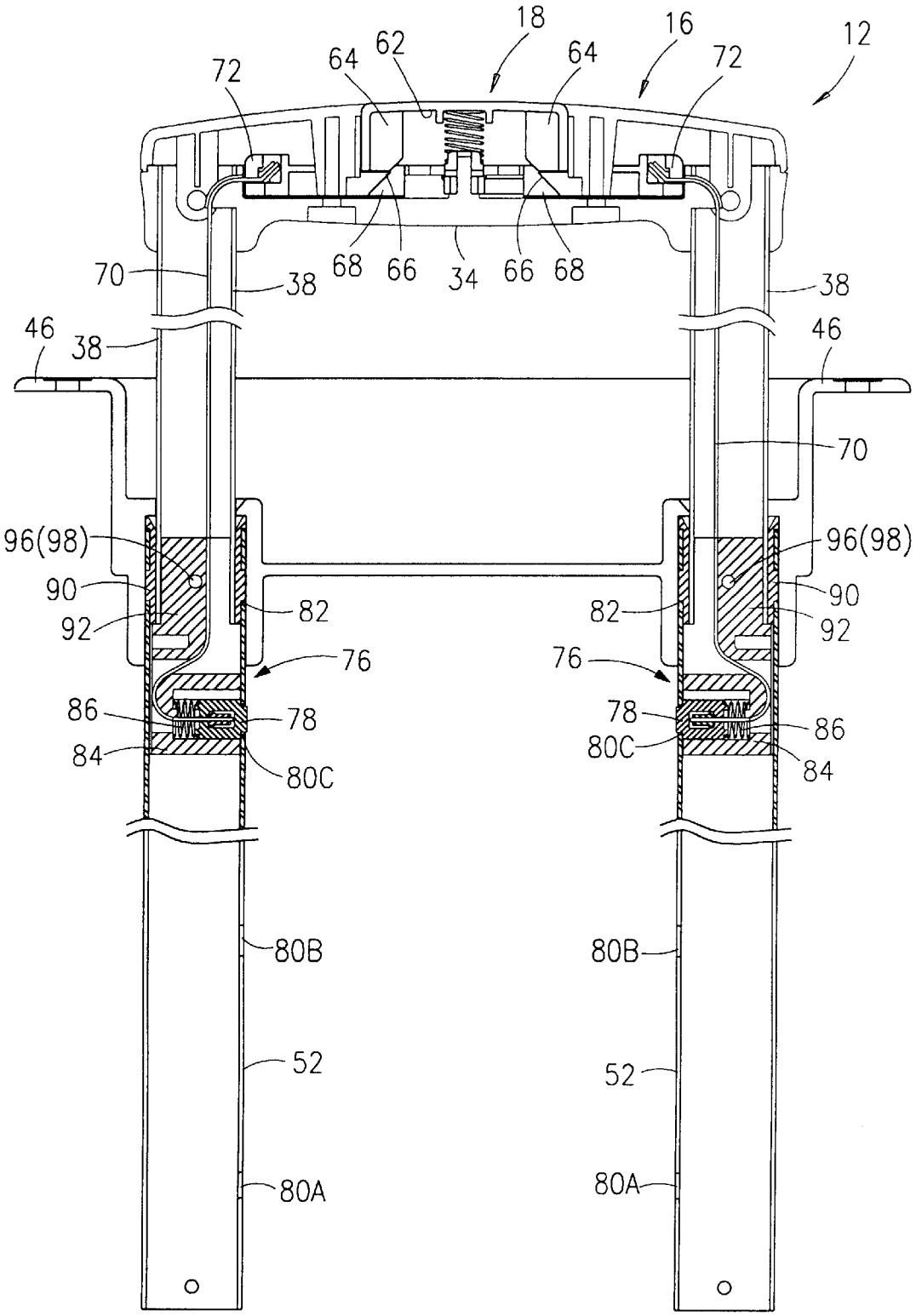
FIG. 9 is sectional view of the handle assembly of the present invention wheeled luggage with push button in a released position and locking pins engaged with the upper slots in the outer tubes such that handle grip is locked in fully extended position for pulling the luggage.

FIG. 9 is a sectional view of the handle assembly 12 with locking pins 78 engaged with the upper slots 80C in the outer tubes 52 such that handle grip 16 is locked in fully extended position for pulling the luggage 10.

Figure 11:
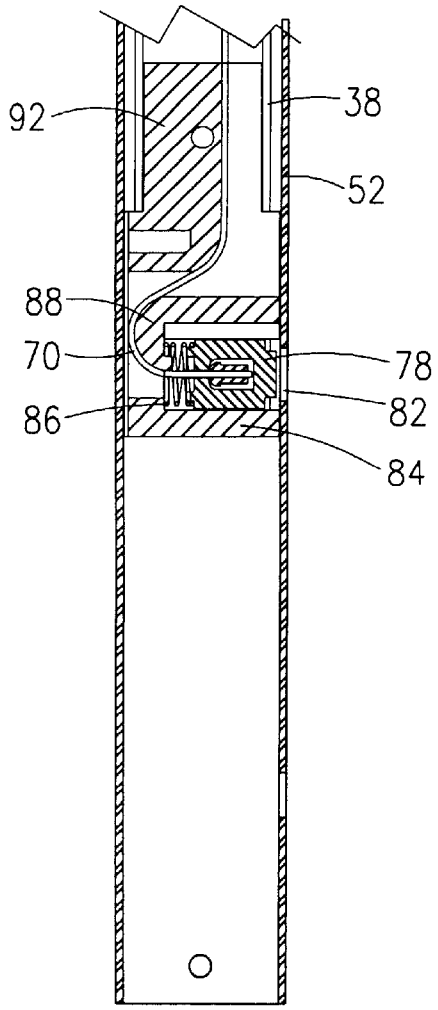
FIG. 11 is an enlarged sectional view of the present invention locking mechanism.
Figure 10:
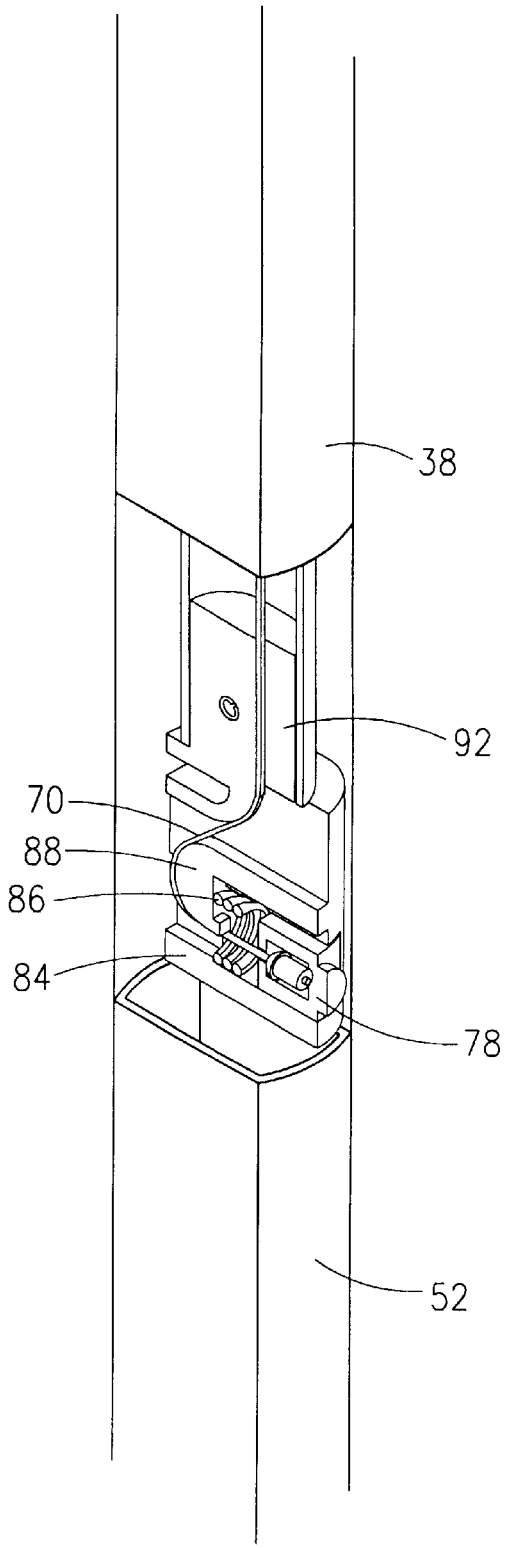
FIG. 10 is a partially cut-away, perspective view of the present invention locking mechanism.
Figure 12:
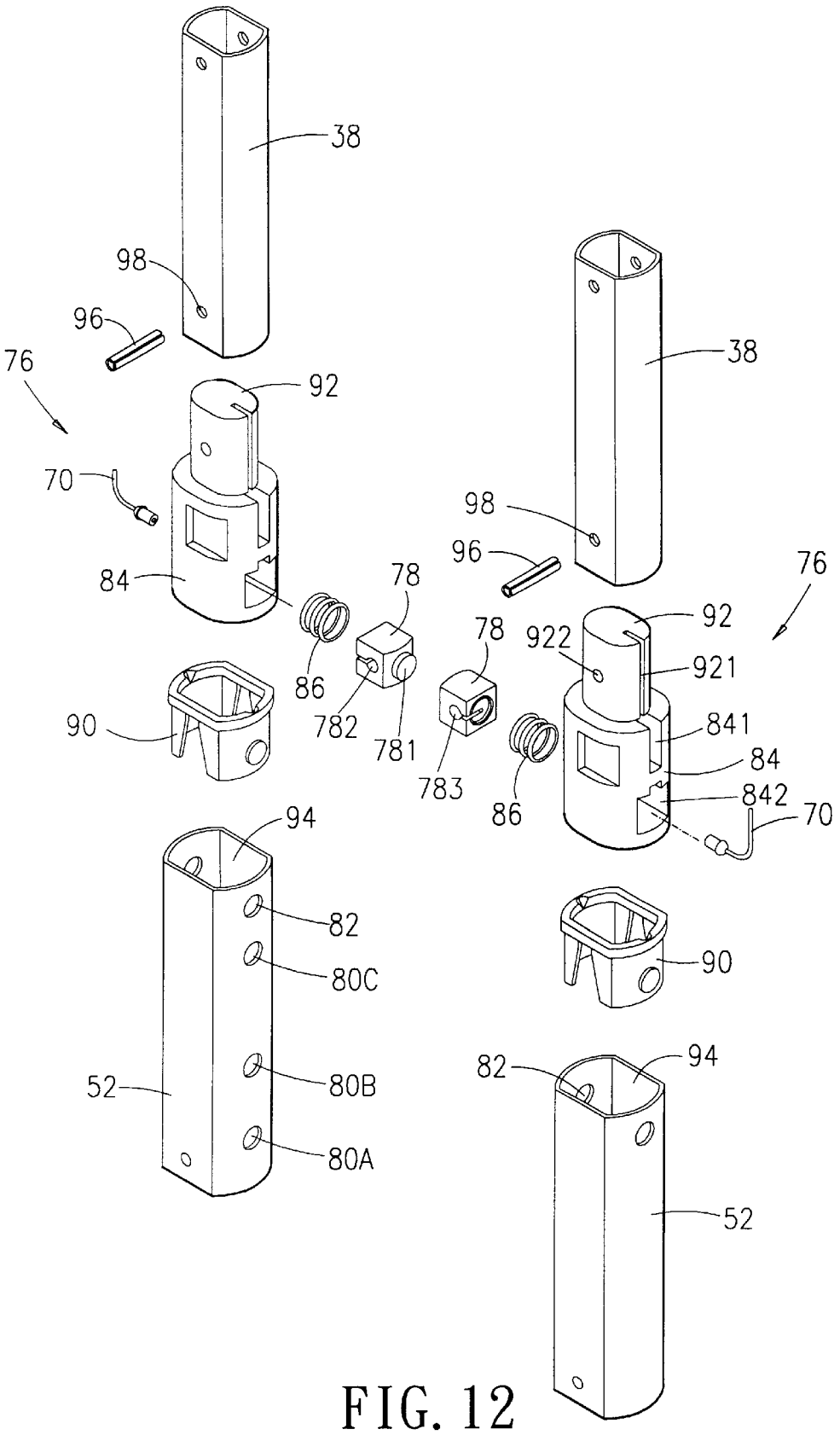
FIG. 12 is an exploded view of the components used in the present invention locking mechanism.

FIGS. 10–12 illustrate the components of locking mechanism and its assembly. As shown, locking mechanism 76 comprises a housing 84 having an upper portion 92 with a guide groove 921 and a pin hole 922 such that a pin 96 may insert through lower hole 98 of inner tube 38 and pin hole 922 to secure locking mechanism 76 and the inner tube 38 together, and the housing 84 with a cavity 842 and a smoothly curved portion 88 (see FIGS. 11 and 12). A spring 86 is received in the cavity 842. A locking block 78 is provided in a cavity 842 of the housing 84 having a locking pin 781 on a first end, an aperture 782 on a second side, and an opening 783 in communication with the aperture 782; a flexible steel cable 70 is provided between the locking block 78 and the push button 18. It means that the locking block 78 having a locking pin 781 slidingly engages within a lock housing 84 and is pulled by flexible steel cable 70 against a compressible spring 86. The housing 84 is further provided with a smoothly curved portion 88 to facilitate the sliding of the flexible steel cable 70 on the housing 84. It is also seen that lock housing 84 is mounted to inner tube 38 at an upper end 92 and further engages the interior cavities 94 of outer tube 52 through a mounting bracket 90. The upper end 92 of lock housing 84 is removably attached to inner tube 38 through a pin 96 and an aperture 98 in the inner tube 38.

Figure 13A:
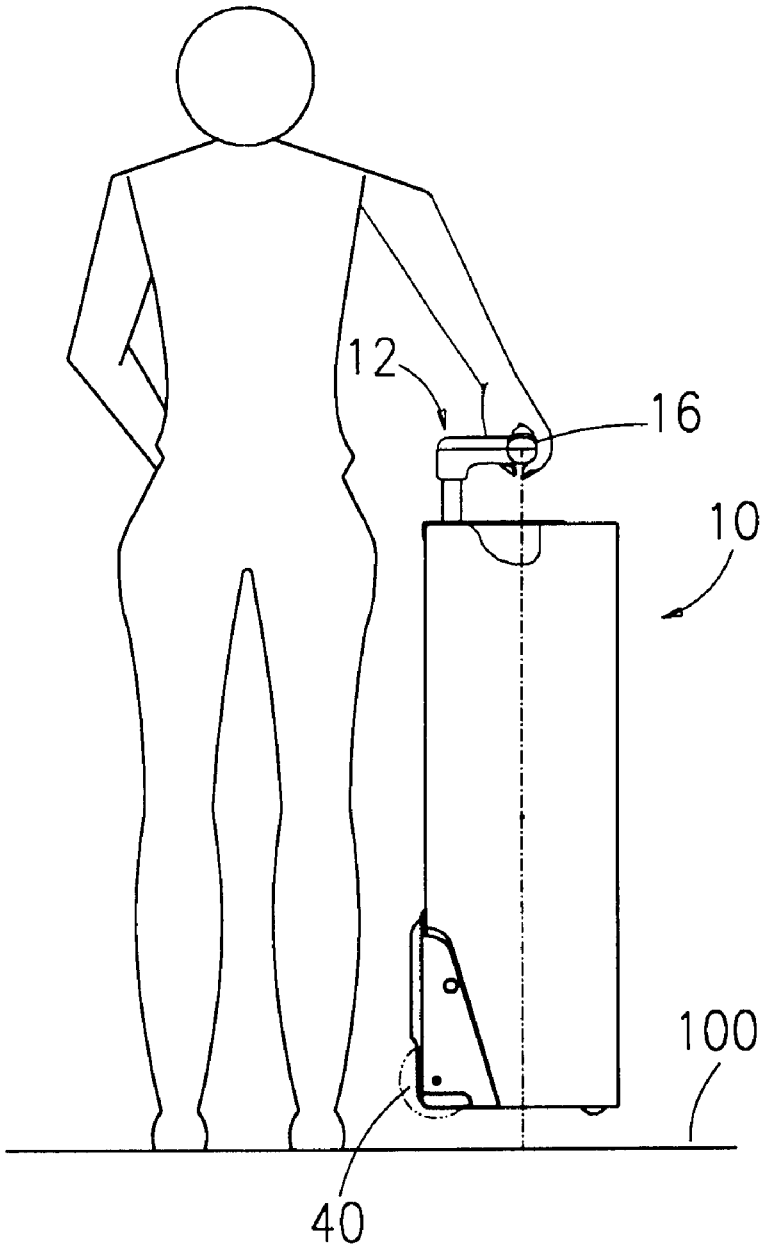
FIGS. 13A, 13B, and 13C are illustration of the present invention handle assembly showing the center line of handle grip vs. the center line of luggage in three different bezel designs.
Figure 13B:
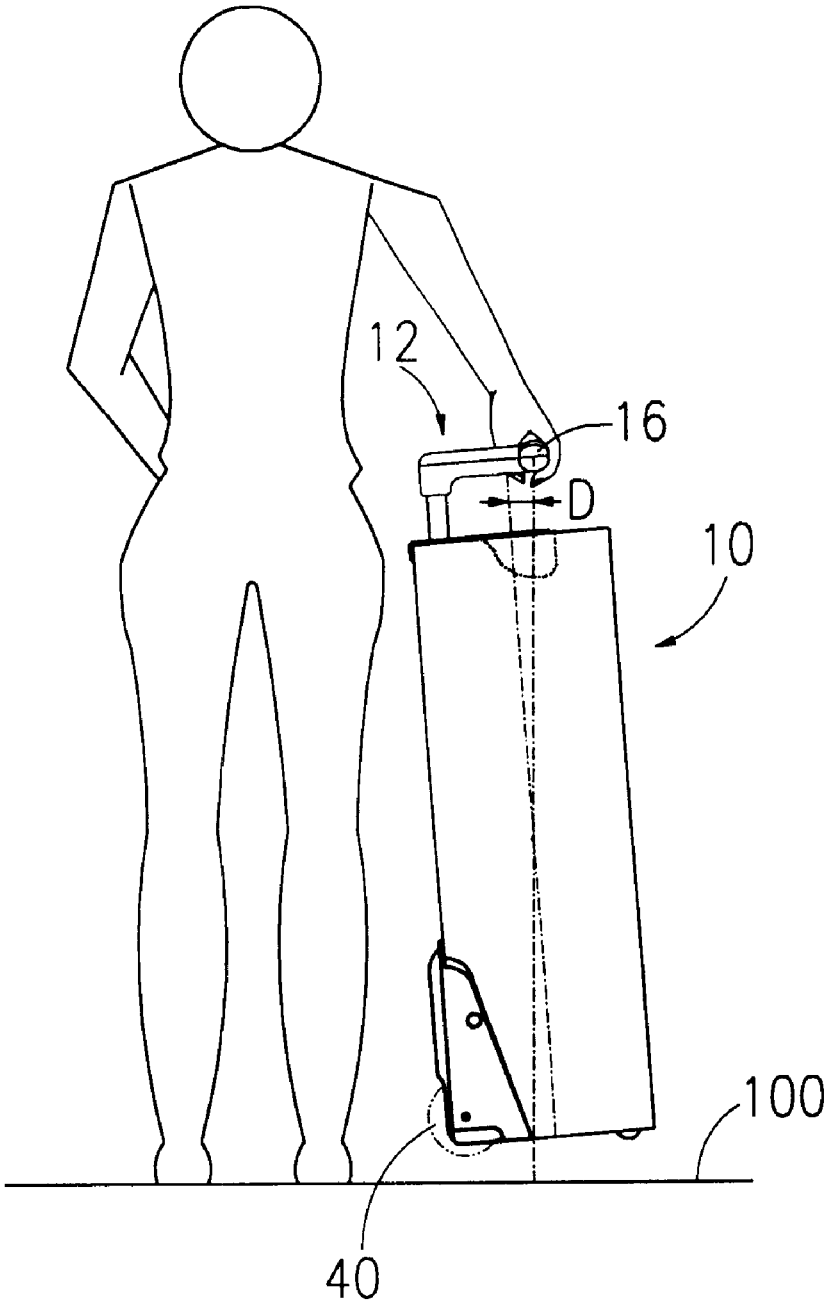
Figure 13C:
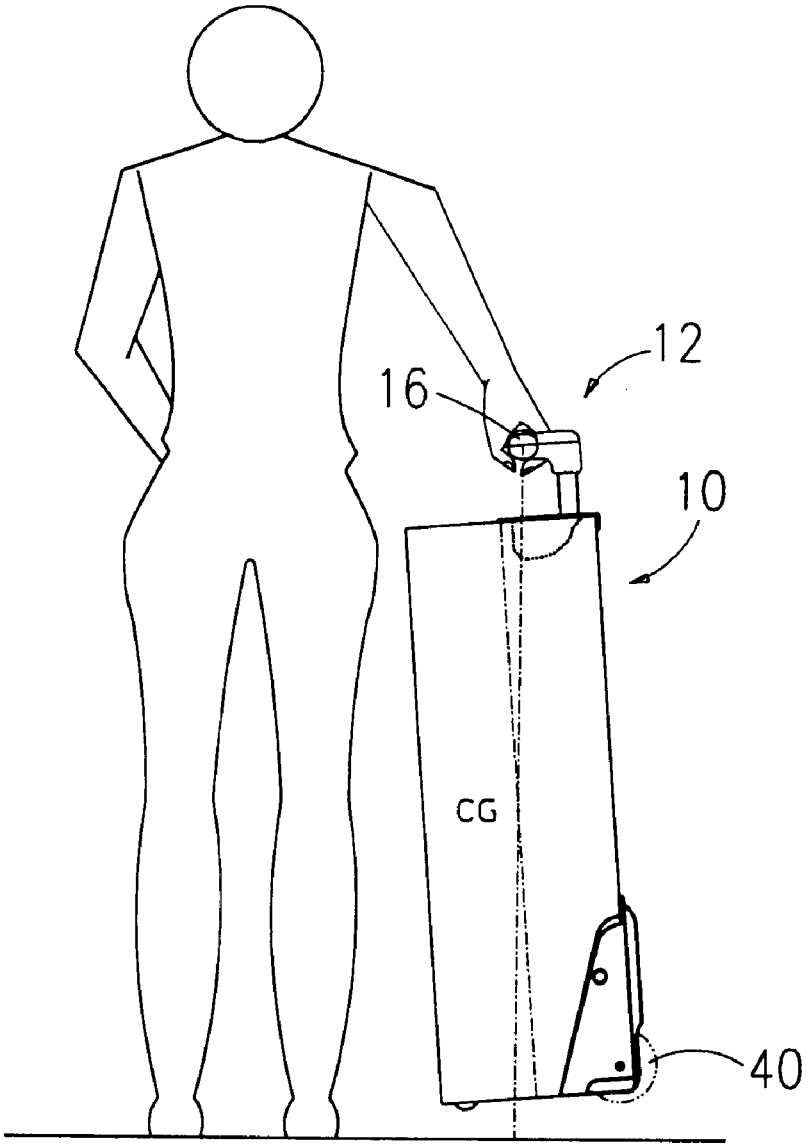

FIGS. 13A–13C are illustration of the present invention handle assembly 12 showing the center line of handle grip 16 vs. the center line of luggage 10 in three different bezel designs. As shown in FIG. 13A, the center line of handle grip 16 is designed to coincide with the center line of luggage 10 such that when the luggage is picked up by handle grip 16, luggage 10 is perpendicular to ground surface 100. As shown in FIG. 13B, the center line of handle grip 16 is positioned at a distance "D" to the right of the center line of luggage 10 and wheels 40 tilt away from the user when luggage is picked up and carried. Similarly, as shown in FIG. 13C, the center line of handle grip 16 is designed to the left of center line of luggage 10, and wheels 40 tilt away from the user when luggage is picked up and carried.

Figure 14:
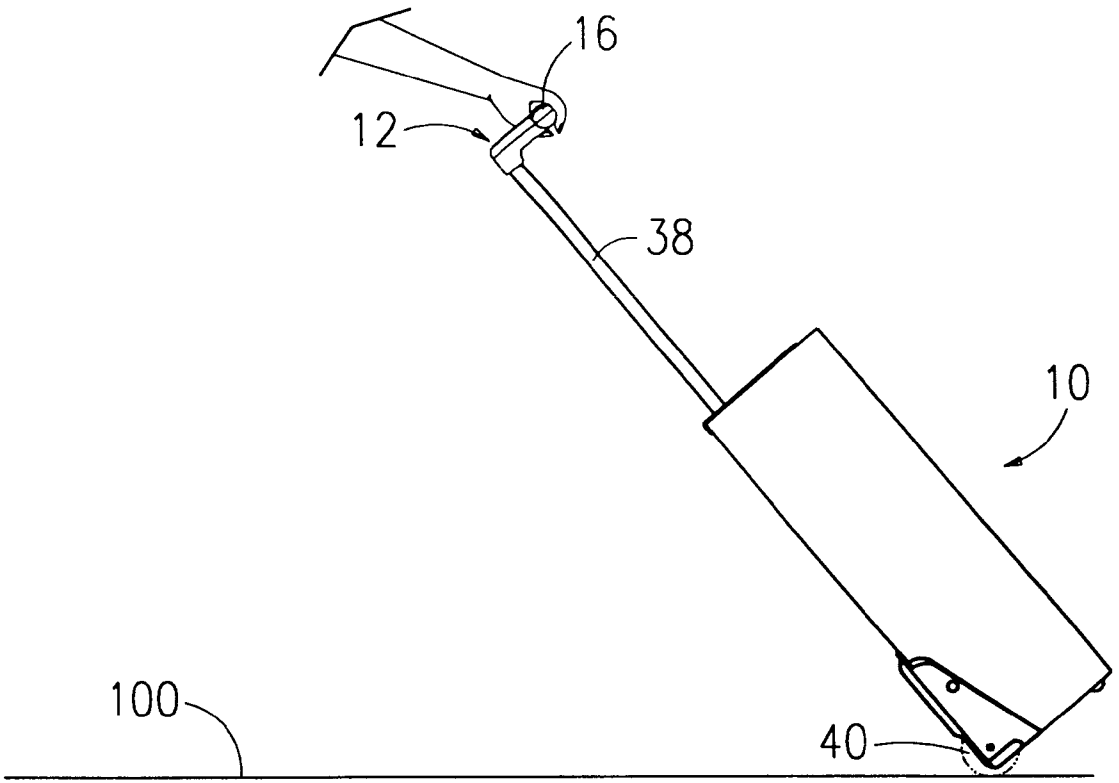
FIG. 14 is an illustration of the present invention wheeled luggage in a fully extended position for operating the luggage on wheels.

FIG. 14 illustrates the handle assembly 12 in a fully extended position such that handle grip 16 can be pulled with wheels 40 rolling on the ground surface 100.

While the invention herein disclosed has been described by means of specific embodiments, numerous modifications and variations could be made thereto by those skilled in the art without departing from the scope of the invention set forth in the claims.

What is claimed is:

1. A wheeled luggage comprising:

a handle assembly having a handle grip with a push button, a pair of outer tubes having upper slots, middle slots, and lower slots, and a pair of inner tubes mounted to the handle grip, each inner tube slidingly engaged with one of the pair of outer tubes;

a bezel on a top of the luggage configured to receive the handle assembly;

a locking device mounted to a bottom end of each inner tube and including a lock house having a curved portion, a locking block with a locking pin movably mounted in the lock house, and a first spring biasing the locking pin to engage one of the slots in the outer tubes such that the handle assembly is in a stowed-away position, a partially extended position or a fully extended position; and, a flexible steel cable having a first end operatively connected to the push button and a second end directly attached to the locking pin, the flexible steel cable having a curved portion in contact with the curved portion of the lock house;

wherein disengagement of the locking pins from the corresponding slots is carried out by pressing the push button thereby causing the flexible steel cables to move the locking pins to move against the bias of the first springs and escape from engagement with the corresponding slot.

2. The wheeled luggage of claim 1, wherein the handle grip further comprises:

a second spring supporting a bottom of the push button;

two wedges projecting downwardly from a bottom of the push button, the wedges being arranged symmetrically with respect to a center of the push button;

two inclined bottom surfaces located at bottoms of the wedges;

two sliding blocks arranged symmetrical to a center of the push button; and two cable mounting blocks;

wherein the inclined bottom surfaces engage the sliding blocks such that when the push button is pressed downwardly against the second spring, the inclined bottom surfaces engage the sliding blocks to move the sliding blocks toward a center of the push button, whereby the flexible steel cables attached to the sliding blocks through the cable mounting blocks are pulled up causing second ends of the flexible steel cables to operate the locking pins of the locking devices.

3. The wheeled luggage of claim 2, wherein the first ends of the flexible steel cables are connected to the cable mounting blocks.

4. The wheeled luggage of claim 1, wherein each locking pin comprises: a front protrusion substantially conforming to the slots; and a back recess receiving and securing a lower end of one of the flexible steel cables.

5. The wheeled luggage of claim 1, wherein the handle grip coincides with a transverse center line of the luggage.

6. The wheeled luggage of claim 1, wherein the handle grip is positioned to one side of transverse center line of the luggage.

* * * * *